United States Patent [19]

Reist

[11] Patent Number: 5,054,760

[45] Date of Patent: Oct. 8, 1991

[54] APPARATUS FOR CONVEYING FLAT PRODUCTS

[75] Inventor: Walter Reist, Hinwil, Switzerland

[73] Assignee: Ferag AG, Hinwil, Switzerland

[21] Appl. No.: 394,094

[22] Filed: Aug. 15, 1989

[30] Foreign Application Priority Data

Aug. 16, 1988 [CH] Switzerland ..... 03065/88

[51] Int. Cl.[5] ..... B65H 29/00

[52] U.S. Cl. ..... 271/69; 271/198; 271/216; 198/600

[58] Field of Search ..... 271/69, 190, 198, 216; 198/609

[56] References Cited

U.S. PATENT DOCUMENTS

| | | | |
|---|---|---|---|
| 1,030,479 | 6/1912 | Ofstad | 198/600 |
| 1,385,468 | 7/1921 | Pflanze . | |
| 2,268,724 | 1/1942 | Shackelford | 198/600 |
| 2,536,961 | 1/1951 | Smith | 198/600 |
| 2,569,711 | 10/1951 | Foster | 198/600 |
| 2,729,324 | 1/1956 | Howdle | 271/69 |
| 3,307,516 | 3/1967 | Wong et al. | 198/600 |
| 3,842,719 | 10/1974 | Fernandez-Rana et al. | 271/216 |
| 4,106,767 | 8/1978 | Schirrmeister et al. . | |
| 4,667,953 | 5/1987 | Hirakawa et al. | 271/216 |
| 4,805,890 | 2/1989 | Martin | 271/216 |

FOREIGN PATENT DOCUMENTS

| | | | |
|---|---|---|---|
| 1561738 | 3/1971 | Fed. Rep. of Germany . | |
| 619403 | 8/1978 | U.S.S.R. | 198/600 |
| 690858 | 4/1953 | United Kingdom | 198/609 |
| 918709 | 2/1963 | United Kingdom | 271/216 |

*Primary Examiner*—Robert P. Olszewski
*Assistant Examiner*—Steve Reim
*Attorney, Agent, or Firm*—Bell, Seltzer, Park & Gibson

[57] ABSTRACT

Cable-type supporting elements (26) are stretched between the two serially arranged belt conveyors (10, 12). The supporting elements (26) are fixed in the end or starting region of the belt conveyors (10, 12) on supporting plates (24) over which the conveying sides of the conveyor belts (14) slide. The supporting elements (26) support the leading edges (30) of the printed products (28) in the region between the two belt conveyors (10, 12).

11 Claims, 1 Drawing Sheet

APPARATUS FOR CONVEYING FLAT PRODUCTS

FIELD OF THE INVENTION

The present invention relates to a method and apparatus for conveying flat products and in particular, for conveying flat printed products.

BACKGROUND OF THE INVENTION

In devices for conveying flat products where two conveyor systems are connected in series, the products are generally not supported in the region between the two conveyor systems. This may present a problem because the flat products may be damaged during the passage from one conveyor system to the other, or may fall between the conveyor systems because they lack enough intrinsic rigidity to bridge the region between the two conveyor systems.

It is known, for example, from FR-A1 2,334,596 to solve this problem by means of endless rotary conveyor belts which overlap the end regions of the conveyor systems. The region between the two conveyor systems is therefore bridged by a rotary belt conveyor, which entails considerable expense and design.

The object of the present invention is therefore to produce a device having two conveyor systems connected in series whose supporting device reliably ensures the passage of the flat products from one conveyor system to the other with the simplest of means.

SUMMARY OF THE INVENTION

The object of the invention is achieved by the provision of a supporting device which has at least one narrow supporting element disposed in a stationary manner in the region between two conveyor systems and extends in the conveyance direction of the conveyor system. Due to the very small sliding surface of the narrow supporting element, the friction between the flat products and the supporting element is very low, so that a reliable passage of the flat products from one conveyor system to the other is ensured, in spite of the stationary supporting element.

In one preferred embodiment, gaps between the end or beginning of the conveyor systems and the supporting device are avoided.

In another preferred embodiment the conveyor systems are belt conveyors which have several parallel, laterally spaced conveyor belts with at least one supporting element fixed at fastening points between every two conveyor belts. A particularly good support is achieved by providing several supporting elements over the entire width of the belt conveyors, fixed between every two conveyor belts.

Two supporting elements, fixed at fastening points laterally outside the conveyor belts, may also be provided. Such an embodiment is also suitable for belt conveyors which have only one conveyor belt.

In a particularly preferred embodiment the conveying sides of the belt conveyors are supported by plate elements and the fastening points for the supporting elements are provided on the plate elements. This permits an extremely simple design.

In an advantageous manner, the device according to the invention is suitable for conveying printed products, such as newspapers, periodicals and the like, occurring in an imbricated formation, in which the leading side of the printed products, viewed in the conveyance direction, is preferably always covered by the printed product preceding it. In such an imbricated formation, the bottom leading side of the printed products is now certain to be guided on the conveying side of the conveyor system connected downstream. This is of particular advantage if the leading side is the open side edge opposite the fold, because without the supporting device it could fan out and the risk of damage to the printed products would thus be particularly great.

BRIEF DESCRIPTION OF THE DRAWINGS

Some of the objects of the invention have been stated and others will become apparent as the description proceeds when taken in conjunction with the accompanying drawings in which.

DETAILED DESCRIPTION OF THE PREFERRED EMBODIMENT

Figure 1:
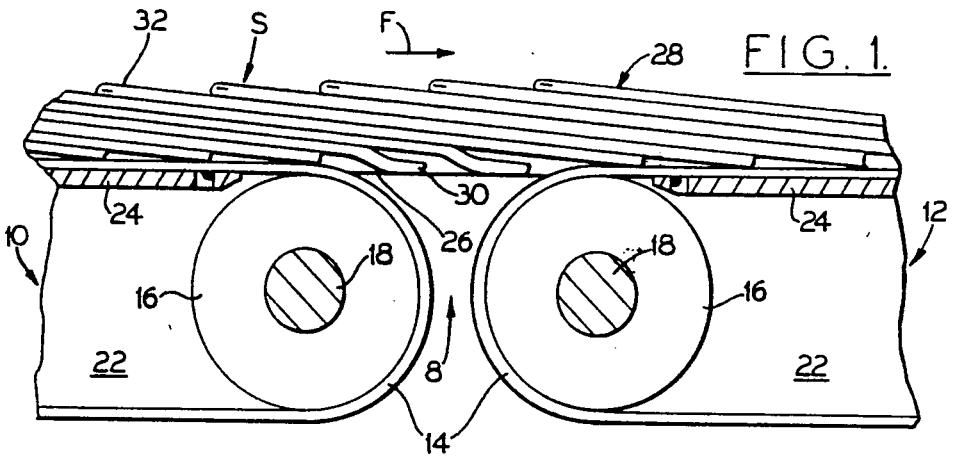
FIG. 1 is a fragmentary cross sectional view of a device with two belt conveyors connected in series taken along the line I—I of FIG. 2.
Figure 2:
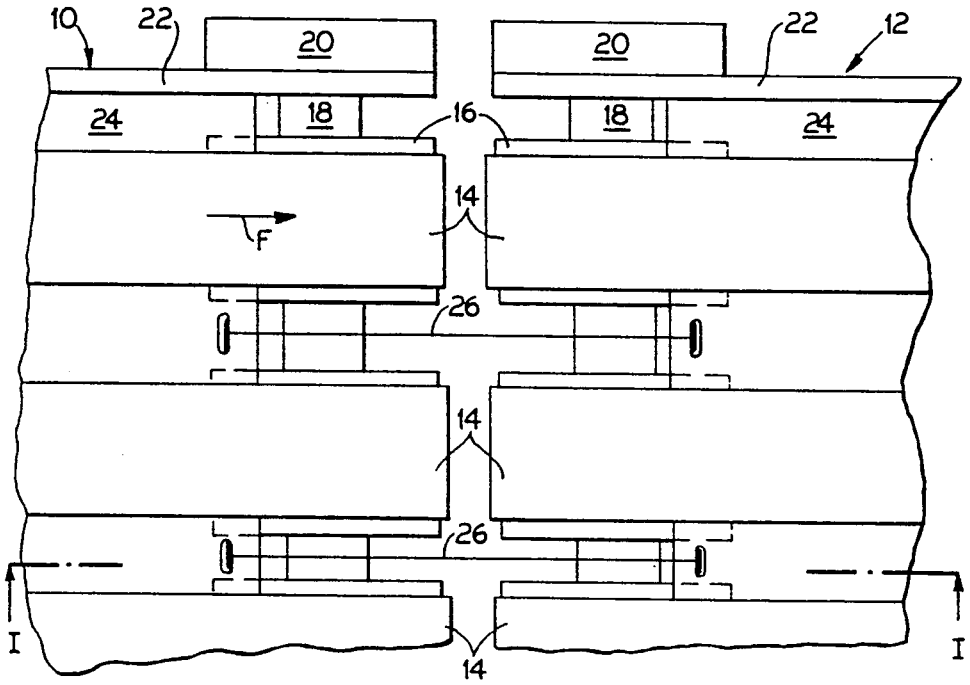
FIG. 2 is a top view of the device shown in FIG. 1 with the imbricated stream of flat printed products removed for clarity.
Figure 3A:
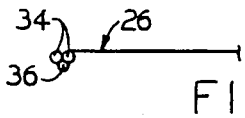
FIG. 3*a* is a fragmentary side view of a first embodiment of a fastening system for the supporting element.
Figure 3D:
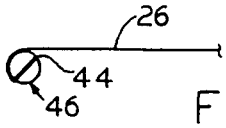
FIG. 3*d* is a fragmentary side view of a fourth embodiment of a fastening system for the supporting element.
Figure 3B:
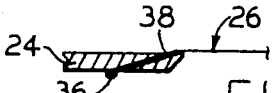
FIG. 3*b* is a fragmentary side view of a second embodiment of a fastening system for the supporting element.
Figure 3E:
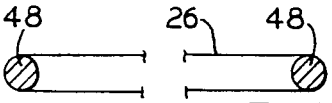
FIG. 3*e* is a fragmentary side view of a fifth embodiment of a fastening system for the supporting element.
Figure 3C:
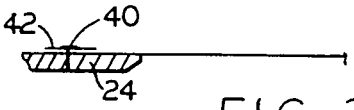
FIG. 3*c* is a fragmentary side view of a third embodiment of a fastening system for the supporting element.

FIGS. 1 and 2 show the transition region 8 of two belt conveyors 10, 12 connected in series, each with several parallel, laterally spaced driven conveyor belts 14 rotating in a conveyance direction F. The conveyor belts 14 are guided around rollers 16 which are mounted on shafts 18, at the end and beginning of the belt conveyors 10, 12. The shafts 18 are mounted on schematically shown bearings 20, which are in turn fixed on lateral bearing brackets 22 of the belt conveyors 10, 12. The conveying sides of the conveyor belts 14 slide over supporting plates 24 which may also be fixed on the bearing brackets 22.

Fixed on the supporting plates 24 in the region between every two conveyor belts 14 are low-friction cable-type supporting elements 26, which for example may be made of plastic or steel cables, and which bridge the region between the two belt conveyors 10, 12 at the level of the conveying sides of the conveyor belts 14.

The folded printed products 28 conveyed by the belt conveyors 10, 12 in conveyance direction F (see FIG. 1) are disposed in an imbricated formation S, in which the leading printed product 28 in each case rests on the one following it. Therefore, the leading edge 30 of each printed product 28 is thus underneath the preceding printed product 28. The leading edge 30 in each case is the open side edge opposite the fold 32 of the printed products 28. In the region of the belt conveyors 10, 12 each leading edge 30 lies on the conveying side of the conveyor belts 14, and in the region between the two belt conveyors 10, 12 the leading edges 30 are supported by the supporting elements 26. The supporting elements 26 thus prevent fanning out of the open side edge 30 of the printed products 28 opposite the fold 32 and guide the leading edges 30 onto the conveying sides of the conveyor belts 14 of the second belt conveyor 12. The printed products 28 are also specifically removed from the first belt conveyor 10 and cannot sag in an uncontrolled manner in the region between the two belt conveyors 10, 12, thus coming out of the imbricated formation S and falling downwards.

FIGS. *3a–3e* show various ways of fastening the supporting elements 26 to the bearing bracket 22 or supporting plate 24. As shown in FIG. *3a*, the end region of the supporting element 26 is passed through between two pins 34 which are spaced apart by approximately the diameter of the supporting element 26 and is held by an enlarged part 36. The enlarged part 36, for example, may be a lead seal provided on the end of the supporting element 26.

In an embodiment shown in FIG. *3b*, the supporting plate 24 (cf. FIGS. 1 and 2) has a bore 38 through which the end region of the supporting element 26 is passed. The supporting element 26 is also prevented from slipping out of the bore 38 by an enlarged part 36.

In FIG. *3c*, the end region of the supporting element 26 is clamped between the supporting plate 24 and a washer 42 fixed by means of a screw 40 on the supporting plate 24.

In FIG. *3d*, the end of the supporting element 26 is in a transverse bore 44 through a tensioning shaft 46 running at right angles to the supporting element 26. The end region of the supporting element 26 is wound around the tensioning shaft 46.

In FIG. *3e*, the supporting element 26 forms an endless loop gripping around two fixing bolts 48 which are provided in the end or starting region of the two belt conveyors 10, 12.

Supporting elements 26 may also be disposed laterally outside the conveyor belts 14 of the belt conveyors 10, 12. They can also be fixed, for example, on the supporting plates 24 in the region between the outermost conveyor belts 14 and the bearing brackets 22. Such an arrangement of the supporting elements 26 is also suitable for belt conveyors 10, 12 with only one conveyor belt, these conveyor belts always being narrower than the flat products to be conveyed. The thread, wire, cord or cable types of supporting elements 26 can be secured differently or the same at their two ends. For example, an enlarged part 36 can be provided at one end to hold the supporting element 26 at this end as shown in either FIG. *3a* or *3b*, and the other end clamped as shown in FIG. *3c* or fixed as shown in FIG. *3d*. This permits problem-free tensioning of the supporting elements 26. These supporting elements 26 are also suitable in particular for conveyor systems with cam conveyors.

The supporting elements can also be formed by vertical, narrow bridges running from one conveyor system to the other. These can be fixed to the conveyor systems at both ends; but it is also conceivable to fix the bridges at only one side to one conveyor system in a cantilever arrangement. These bridges also advantageously engage in the conveying sections of the conveyor systems, in order to avoid gaps between the conveyor systems and the bridges.

In the drawings and the specification there has been set forth a preferred embodiment of the invention, and although specific terms are employed, they are used in a generic sense only and not for purposes of limitation.

That which is claimed is:

1. An apparatus for conveying flat products comprising two conveyor systems connected in series, and a supporting device bridging the region between them, the supporting device having at least one supporting element extending essentially in the conveyance direction of the conveyor system, for supporting the flat products during their passage from one conveyor system to the other, wherein the supporting element (26) is disposed so that it is stationary ad is made narrow in form, and wherein the supporting element (26) is in the form of a thread, wire, cord or cable and is stretched between the conveyor systems (10, 12), and the supporting element (26) is fastened at opposite ends to fixed fastening points in the ends or receiving regions of the conveyor systems (10, 12).

2. The apparatus as claimed in claim 1, wherein the supporting element (26) is essentially at the conveyance height of the conveyor systems (10, 12).

3. The apparatus as claimed in claim 1, wherein the supporting element (26) has an enlarged part (36) at least one end with which said enlarged part (36) is suspended from a holding device (34, 24, 38).

4. The apparatus as claimed in claim 1, wherein the supporting element (26) is clamped (40, 42) at least at one end.

5. The apparatus as claimed in claim 1, wherein the supporting element (26) is wound around a tensioning shaft (46) at least at one end.

6. The apparatus as claimed in claim 1, wherein the conveyor systems are belt conveyors (10, 12), each with at least one conveyor belt (14).

7. The apparatus as claimed in claim 6, wherein the belt conveyors (10, 12) have several parallel, laterally spaced conveyor belts (14), and at least one supporting element (26) is fixed at fastening points between every two conveyor belts (14).

8. The apparatus as claimed in claim 6, wherein two supporting elements (26) are fastened at fastening points laterally outside the conveyor belts (14).

9. An apparatus for conveying flat products comprising two conveyor systems connected in series, and a supporting device bridging the region between them, the supporting device having at least one supporting element extending essentially int he conveyance direction of the conveyor system, for supporting the flat products during their passage from one conveyor system to the other, wherein the supporting element (26) is disposed so that it is stationary and is made narrow in form, and wherein the supporting element (26) is in the form of a thread, wire, cord or cable and is stretched between the conveyor systems (10, 12), and wherein the supporting element (26) forms an endless loop and grips around a holding element (48) at fixed fastening points provided in the ends or starting regions of the conveyor systems (10, 12).

10. An apparatus for conveying flat products comprising two conveyor systems connected in series, and a supporting device bridging the region between them, the supporting device having at least one supporting element extending essentially in the conveyance direction of the conveyor system, for supporting the flat products during their passage from one conveyor system to the other, wherein the support element (26) is disposed so that it is stationary and is made narrow in form, and wherein the conveyor systems are belt conveyors (10, 12), each with at least one conveyor belt (14), and the belt conveyors (10, 12) have several parallel, laterally spaced conveyor belts (14), and at least one supporting element (26) is fixed at fastening points between every two conveyor belts (14), and the conveyor belts (14) of the belt conveyors (10, 12) are supported by plate elements (24), and the fastening points are provided on the plate elements (24).

11. An apparatus for conveying flat products comprising two conveyor systems connected in series, and a supporting device bridging the region between them, the supporting device having at least one supporting element extending essentially in the conveyance direction of the conveyor system, for supporting the flat products during their passage from one conveyor system to the other, wherein the supporting element (26) is disposed so that it is stationary and is made narrow in form, and wherein the conveyor systems are belt conveyors (10, 12), each with at least one conveyor belt (14), and wherein two supporting elements (26) are fastened at fastening points laterally outside the conveyor belts (14), and the conveyor belts (14) of the belt conveyors (10, 12) are supported by plate elements (24), and the fastening points are provided on the plate elements (24).

* * * * *